US009339928B1

(12) United States Patent
Obitts et al.

(10) Patent No.: US 9,339,928 B1
(45) Date of Patent: May 17, 2016

(54) MECHANIC'S CREEPER

(71) Applicant: Whiteside Mfg. Co., Deleware, OH (US)

(72) Inventors: Shane Obitts, Elyria, OH (US); Kirt E. Whiteside, Marion, OH (US)

(73) Assignee: Whiteside Mfg. Co., Delaware, OH (US)

( * ) Notice: Subject to any disclaimer, the term of this patent is extended or adjusted under 35 U.S.C. 154(b) by 0 days.

(21) Appl. No.: 14/704,099

(22) Filed: May 5, 2015

(51) Int. Cl.
*B25H 5/00* (2006.01)

(52) U.S. Cl.
CPC ..... *B25H 5/00* (2013.01)

(58) Field of Classification Search
CPC ..... B25H 5/00
USPC ..... 280/32.6; D34/23
See application file for complete search history.

(56) References Cited

U.S. PATENT DOCUMENTS

| | | | | | |
|---|---|---|---|---|---|
| 5,174,592 | A | * | 12/1992 | Pool | 280/32.6 |
| 5,730,449 | A | * | 3/1998 | Miles | 280/32.6 |
| D396,920 | S | | 8/1998 | Whiteside et al. | |
| D401,714 | S | | 11/1998 | Whiteside et al. | |
| D401,715 | S | | 11/1998 | Whiteside et al. | |
| D403,822 | S | | 1/1999 | Whiteside et al. | |
| 5,947,489 | A | * | 9/1999 | Tucker | 280/32.6 |
| 6,705,622 | B2 | | 3/2004 | Whiteside | |
| D521,206 | S | | 5/2006 | Obbitts et al. | |
| D521,708 | S | | 5/2006 | Obbitts et al. | |
| D522,707 | S | * | 6/2006 | Obbitts et al. | D34/23 |
| D532,177 | S | * | 11/2006 | Hernandez | D34/23 |
| 7,374,181 | B1 | * | 5/2008 | Wu | 280/32.6 |
| D641,125 | S | * | 7/2011 | McConnell | D34/23 |
| 8,002,289 | B2 | * | 8/2011 | Diaz | 280/32.6 |
| 2003/0168824 | A1 | * | 9/2003 | Miles | 280/32.6 |
| 2005/0161894 | A1 | * | 7/2005 | Lensing | 280/32.6 |
| 2006/0170170 | A1 | * | 8/2006 | Whiteside et al. | 280/32.6 |
| 2007/0080510 | A1 | * | 4/2007 | Ji | 280/32.6 |
| 2008/0157492 | A1 | * | 7/2008 | Chaykin et al. | 280/32.6 |

* cited by examiner

*Primary Examiner* — John Walters
*Assistant Examiner* — Brian Swenson
(74) *Attorney, Agent, or Firm* — Renner, Kenner, Greive, Bobak, Taylor & Weber

(57) ABSTRACT

A creeper (10) includes a frame (11) having spaced side rails (12) and cross rails (13) extending between the side rails (12). A pad (28) is carried by the cross rails (13) and is spaced from each side rail (12). Each side rail (12) has end portions (14, 15) which carry a caster assembly (17), and the cross rails (13) are positioned closer to each other than the caster assemblies (17) are from each other. Each side rail (12) also includes a raised portion (26) which is higher than the end portions (14, 15) when the caster assemblies (17) are on a surface, and a lower portion (23) which is lower than the end portions (14, 15) when the caster assemblies are on a surface.

11 Claims, 4 Drawing Sheets

MECHANIC'S CREEPER

TECHNICAL FIELD

This invention relates to a creeper as used by mechanics when servicing vehicles. More particularly, this invention relates to a creeper which is sturdy and easy to maneuver.

BACKGROUND ART

Most all creepers include side rails with cross rails extending between them at the end thereof and at the center thereof. Most often the side rails are flat in side profile. A pad is positioned on top of the side rails and cross rails, and the side rails carry a plurality of caster assemblies to render the creeper mobile.

Such creepers often lack stability in that the caster assemblies are generally under the edges of the pad and at the intersection of the side rails and cross rails. In addition, such creepers often lack maneuverability in that no portion of the creeper assists the user in moving the creeper. Rather, the user must engage the floor and push with his feet or hands to move the creeper. Moreover, such creep with at least front, rear, and center cross rails require unnecessary material adding to the expense thereof.

DISCLOSURE OF THE INVENTION

It is thus an object of one aspect of the present invention to provide a creeper which can more stabably be moved on a surface.

It is an object of another aspect of the invention to provide a creeper, as above, which is more easily maneuvered on a surface.

It is an object of an additional aspect of the present invention to provide a creeper, as above, which is more economically manufactured.

These and other objects of the present invention, as well as the advantages thereof over existing prior art forms, which will become apparent from the description to follow, are accomplished by the improvements hereinafter described and claimed.

In general, a creeper made in accordance with one aspect of the present invention includes a frame and a pad carried by the frame. The frame includes longitudinally extending, laterally spaced side rails. Caster assemblies are carried near the longitudinal ends of each side rail. The frame includes two cross rails extending laterally between the side rails adjacent to the caster assemblies. The cross rails are longitudinally spaced a distance less than the longitudinal distance between the caster assemblies.

In accordance with another aspect of the invention, a creeper includes a frame and a pad carried by the frame. The frame includes longitudinally extending, laterally spaced side rails, each side rail having a longitudinal end portion. A caster assembly is carried by each end portion such that when the caster assemblies are engaging a surface, the end portions are at a first height. Each side rail also includes a raised portion such that when the caster assemblies are engaging a surface, the raised portions are at a second height which is at a greater distance from the surface than the first height.

A creeper made according to yet another aspect of the invention includes longitudinally extending, laterally spaced side rails. Caster assemblies are carried by the side rails. Longitudinally spaced cross rails extend laterally between the side rails and a longitudinally extending pad is carried by the cross rails. The pad is laterally spaced from each of the side rails.

A creeper having all features of these aspects of the present invention includes a frame having longitudinally extending, laterally spaced side rails and cross rails extending laterally between the side rails. A longitudinally extending pad is carried by the cross rails and is laterally spaced from each side rail. Each side rail has longitudinal end portions and a caster assembly is carried by the end portions such that when the caster assemblies are engaging a surface, the end portions are at a first height. The cross rails are positioned adjacent to the caster assemblies but spaced from each other a distance less than the longitudinal distance between the caster assemblies. Each side rail also includes a raised portion such that when the caster assemblies are engaging a surface, the raised portions are at a second height which is at a greater distance from the surface than the first height.

A mechanic's creeper made according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
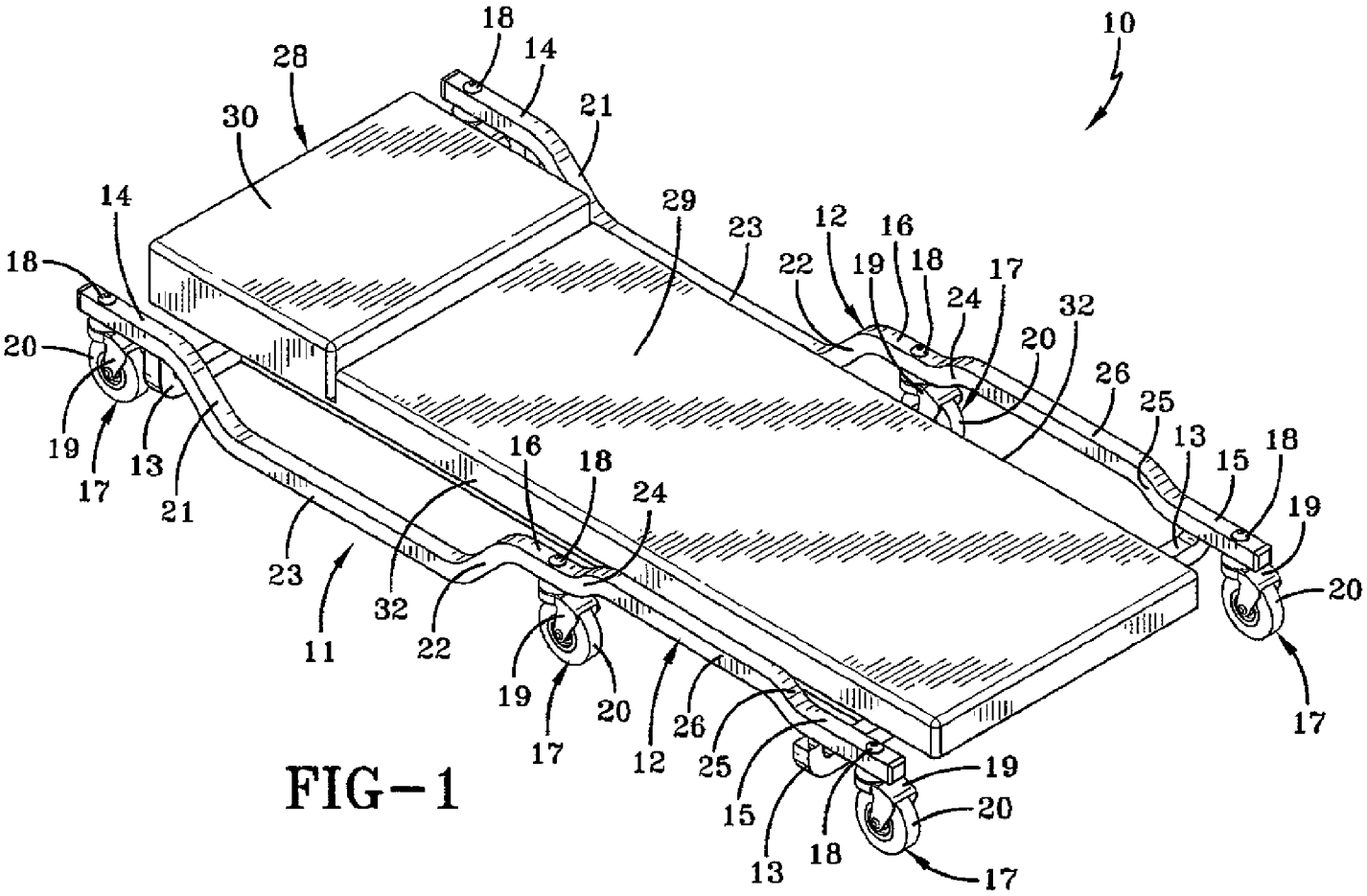
FIG. 1 is a perspective view of a mechanic's creeper made in accordance with the concepts of the present invention.
Figure 2:
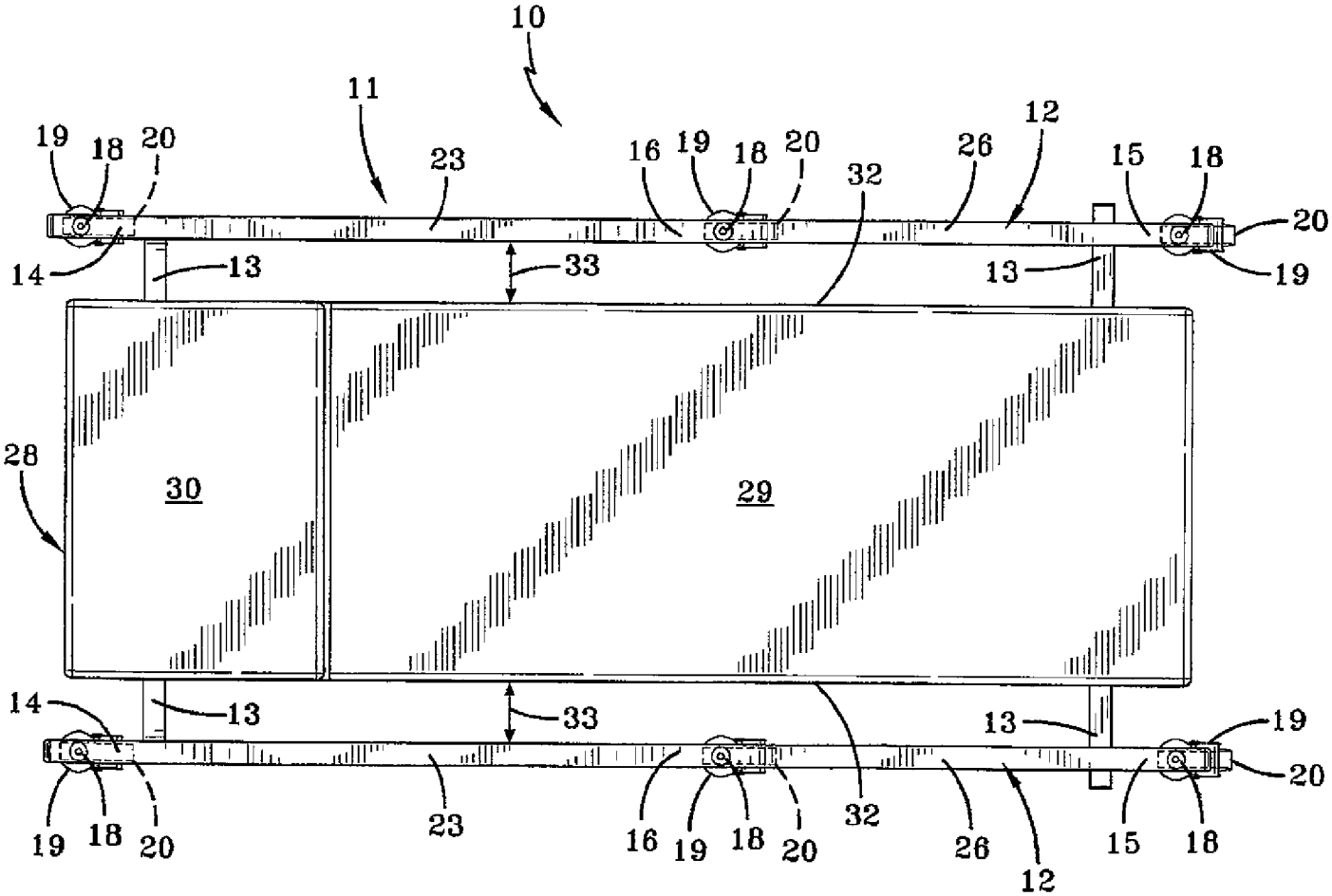
FIG. 2 is a top plan view thereof.

A creeper intended to be used primarily by a mechanic or the like is generally indicated by the numeral 10. Creeper 10 includes a frame, generally indicated by the numeral 11, which includes longitudinally extending, lateral spaced side rails, generally indicated by the numeral 12, and longitudinally spaced cross rails 13, extending laterally between, and attached to, as by welding or the like, side rails 12.

Each side rail 12 includes portions 14 and 15 at the longitudinal ends thereof, and a generally medial portion 16 located between, and on the same place as, end portions 14 and 15. Portions 14, 15 and 16 of each side rail 12 each carry a conventional caster assembly generally indicated by the numeral 17. Each caster assembly 17 includes a stem 18 attached to side rail 12, a bracket 19 rotatably carried by stem 18, and a wheel 20 rotatably carried by bracket 10. When the wheels 20 of caster assemblies 17 are positioned on a surface, such as a floor or the like, portions 14, 15 and 16 at each side rail are thus at the same height.

Each side rail 12 extends downwardly from end portion 14, as a shoulder 21, and downwardly from medial portion 16, as at shoulder 22, to form a lower rail portion 23. When the wheels 20 of caster assemblies 17 are positioned on a surface, portion 23 is thus at a height less than the height of portions 14, 15 and 16. As will become more evident, portion 23 tends to accommodate the shoulders of a person laying on creeper 10.

Each side rail 12 extends upwardly from medial portion 16, as at shoulder 24, and upwardly from end portion 15, as at shoulder 25, to form a raised or upper rail portion 26. Thus, when the wheels 20 of caster assemblies 17 are positioned on a surface, portion 26 is at a height which is at a greater distance from the surface than the height of portions 14, 15 and 16. Such is advantageous in that shoulders 24 may be conveniently engaged by the hands of the user to assist in the maneuvering of creeper 10.

Figure 3:
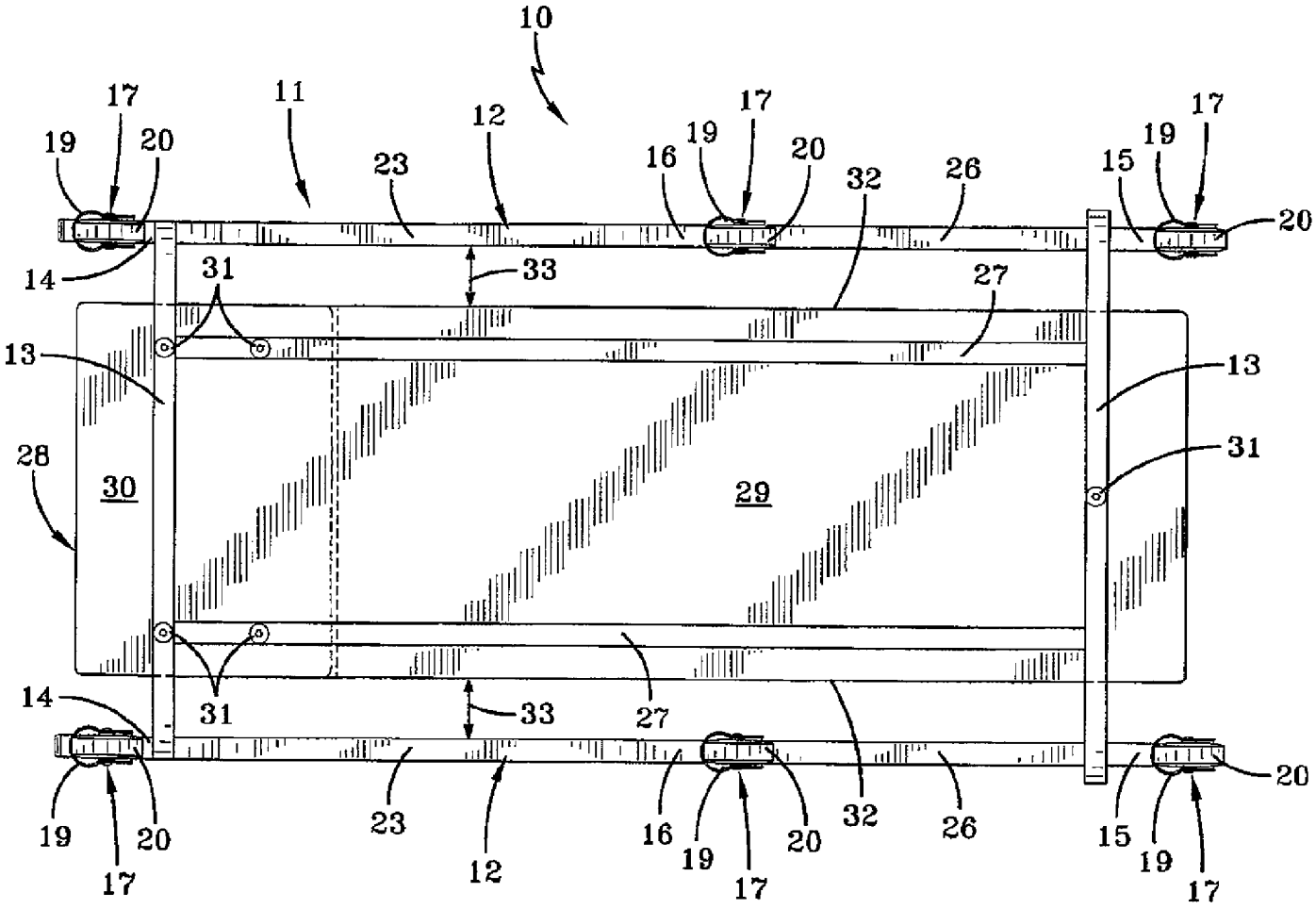
FIG. 3 is a bottom plan view thereof.
Figure 4:
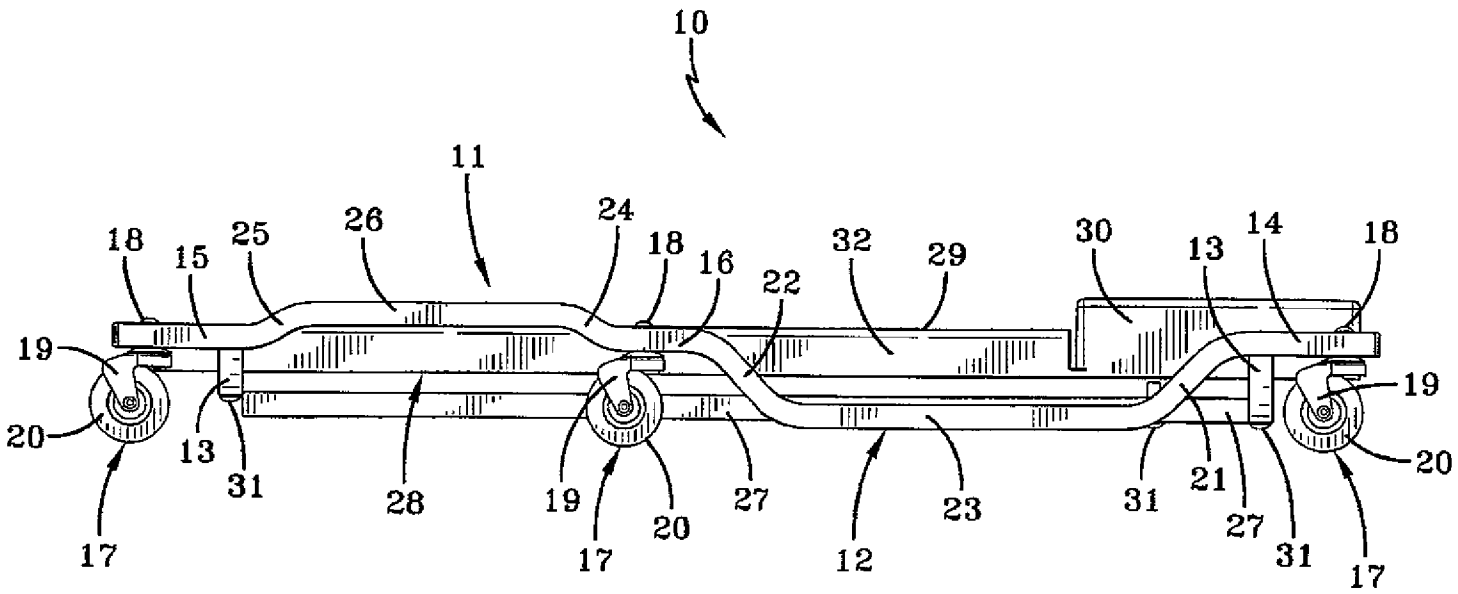
FIG. 4 is a side elevational view thereof.

As shown in FIG. 3, frame 11 also includes laterally spaced support rails 27 longitudinally extending between cross rails 13. Together, cross rails 13 and rails 27 support a pad generally indicated by the numeral 28. Pad 28 can include a body portion 29 and a head rest 30, and is attached to rails 13 and 12 as by fasteners 31 located at any desired position along rails 13 and 12. Side rails 12 are spaced a relatively substantial distance from the lateral edges 32 of pad 28 thus positioning caster assemblies 17 further laterally apart than the lateral extent of pad 30 and thereby providing more stability to creeper 10. This distance, indicated by the numeral 33, is preferably approximately twenty-five percent of the lateral width of pad 28.

As is also best seen in FIG. 3, cross rails 13 connect to side rails 12 at a point on end portions 14 and 15 close to shoulders 21 and 25. As such, cross rails 13 are longitudinally spaced closer to each other than are the caster assemblies 17 located at each end of side rails 12. Such inner location of cross rails 13 increases the stability of creeper 10 and contributes to the elimination of a central cross rail found in most conventional creepers. It should also be noted that pad 28 extends longitudinally outward of cross rails 13 which provides more support to pad 28 than conventional creepers having the cross rails under the longitudinally ends of the pad and aligned with the casters.

In light of the foregoing, it should thus be evident that a creeper constructed as described herein substantially improves the art and otherwise accomplishes the objects of the present invention.

What is claimed is:

1. A creeper comprising a frame, a pad carried by said frame, said frame including longitudinally extending, laterally spaced side rails having longitudinal end portions, and caster assemblies carried by said end portions of said side rails such that when said caster assemblies are engaging a surface, said end portions are at a first height, each said side rail including a raised portion such that when said caster assemblies are engaging a surface, said raised portions are at a second height which is a greater distance from the surface than the first height, said frame including cross rails extending laterally between said side rails adjacent to said caster assemblies, said cross rails being longitudinally spaced at a distance less than the longitudinal distance between said caster assemblies.

2. A creeper comprising a frame, a pad carried by said frame, said frame including longitudinally extending laterally spaced side rails, each said side rail having longitudinal end portions, and a caster assembly carried by each end portion such that when said caster assemblies are engaging a surface, said end portions are at a first height, each said side rail including a raised portion such that when said caster assemblies are engaging a surface, said raised portions are at a second height which is a greater distance from the surface than the first height.

3. The creeper of claim 2 wherein said pad is carried by and extends longitudinally between said cross rails, said pad being laterally spaced from each of said side rails.

4. The creeper of claim 3 further comprising longitudinally extending support rails, said support rails also carrying said pad.

5. The creeper of claim 3 wherein said pad extends longitudinally outwardly from said cross rails.

6. The creeper of claim 2 wherein said side rails include a generally medial portion positioned at the first height when said caster assemblies are engaging a surface.

7. The creeper of claim 6 wherein additional caster assemblies are carried by said medial portions.

8. The creeper of claim 6 wherein said raised portions are formed by a shoulder extending upwardly from said medial portions and a shoulder extending upwardly from one of said end portions.

9. The creeper of claim 6 wherein said side rails include a lower portion such that when said caster assemblies are engaging a surface, said lower portions are at a third height which is a lesser distance from the surface than the first height.

10. The creeper of claim 9 wherein said lower portions are formed by a shoulder extending downwardly from the other of said end portions and a shoulder extending downwardly from said medial portions.

11. A creeper comprising a frame having longitudinally extending, laterally spaced side rails and cross rails extending laterally between said side rails, a longitudinally extending pad carried by said cross rails and being laterally spaced from each said side rail, each said side rail having longitudinal end portions, and a caster assembly carried by each said end portion such that when said caster assemblies are engaging a surface, said end portions are at a first height, said cross rails being positioned adjacent to said caster assemblies but spaced from each other a distance less than the longitudinal distance between said caster assemblies, and each said side rail including a raised portion such that when said caster assemblies are engaging a surface, the raised portions are at a second height which is a greater distance from the surface than the first height.

* * * * *